US007330683B2

(12) United States Patent
Matsuzaki

(10) Patent No.: US 7,330,683 B2
(45) Date of Patent: Feb. 12, 2008

(54) CIRCUMFERENTIAL SPEED AND DEVELOPER CHARACTERISTICS

(75) Inventor: Koichi Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/582,438

(22) Filed: Oct. 18, 2006

(65) Prior Publication Data

US 2007/0110483 A1 May 17, 2007

(30) Foreign Application Priority Data

Nov. 15, 2005 (JP) ..... 2005-329763

(51) Int. Cl.
*G03G 15/08* (2006.01)

(52) U.S. Cl. ..... 399/279; 399/292; 399/293

(58) Field of Classification Search ..... 399/279, 399/236, 252, 265, 292, 293
See application file for complete search history.

(56) References Cited

U.S. PATENT DOCUMENTS

2002/0106219 A1* 8/2002 Sakai et al. ..... 399/222
2003/0175043 A1* 9/2003 Handa et al. ..... 399/111
2007/0098436 A1* 5/2007 Arakawa ..... 399/103

FOREIGN PATENT DOCUMENTS

JP 2001-042563 2/2001

OTHER PUBLICATIONS

English translation of Tosaka et al. (JPO pub #2001-042563).*

* cited by examiner

*Primary Examiner*—David M. Gray
*Assistant Examiner*—Geoffrey T Evans
(74) *Attorney, Agent, or Firm*—Rabin & Berdo, PC

(57) ABSTRACT

A developing device includes a developer bearing body disposed in opposition to a latent image bearing body for bearing a latent image thereon. The developer bearing body develops the latent image using a developer. The developer has a degree of circularity greater than or equals to 0.93. The developing device further includes a developer layer forming member that contacts the developer on the developer bearing body to thereby form a developer layer. The developer bearing body rotates at a circumferential speed within a range from 185 mm/sec to 250 mm/sec. The initial fluidity of the developer is greater than or equals to 80%, and the tapping density of the developer is less than or equals to 35%.

18 Claims, 2 Drawing Sheets

CIRCUMFERENTIAL SPEED AND DEVELOPER CHARACTERISTICS

BACKGROUND OF THE INVENTION

This invention relates to an image forming apparatus such as a printer, and particularly relates to an image forming apparatus having a developing device that uses a developer such as a toner.

Generally, an electrophotographic image forming process includes a charging process, an exposing process, a developing process, a transfer process and a fixing process. In the charging process, a photoconductive insulation layer of a latent image bearing body is uniformly charged. In the exposing process, the photoconductive insulation layer is exposed with light, and electric charge on the exposed portion vanishes so that a latent image is formed. In the developing process, a toner as a developer (including, at least, a coloring agent) adheres to the latent image and visualizes the latent image. In the transfer process, the visualized image is transferred to a printing medium such as a transfer paper or the like. In the fixing process, the transferred image is fixed to the printing medium by means of heat and pressure, or other appropriate fixing method.

In an image forming apparatus using the above described electrophotography, the density unevenness may appear in the form of stripe pattern on the image (referred to as image jitter) due to uneven movement of mechanical components (for example, uneven rotation of the latent image bearing body), and therefore the image quality may be degraded. The uneven rotation of the latent image bearing body is caused by a mechanical load or the like applied by a developer bearing body disposed in contact with the latent image bearing body. Japanese Laid-Open Patent Publication (see Page 1 and FIG. 1) discloses the image forming apparatus in which the circumferential (linear) speed (i.e., printing speed) of the latent image bearing body is set within a range from 20 to 150 mm/sec and the toner cohesion is defined within a range from 30 to 80%. With such conditions, the load applied to the latent image bearing body by the developer bearing body can be reduced, and the image jitter can be restricted.

However, recently, the printing speed of the image forming apparatus becomes faster in order to meet the demand for high speed printing. As the printing speed becomes faster, the toner tends to be compressed in the vicinity of a contact portion between the developer bearing body and a developer layer forming member (such as a developing blade) for forming a toner layer on the developer bearing body, even if the toner cohesion is defined as disclosed in the above described publication. This phenomenon is called as "packing". In such a case, the developer bearing body is applied with a pressure due to the packing of the toner, in addition to a pressure applied by the developing blade under ordinary conditions. Consequently, at a portion where the packing of the toner occurs, the pressure applied to the developer bearing body may increase, and the amount of the toner may decrease. As a result, the thickness of the toner layer on the developer bearing body may become uneven, and therefore the image jitter may appear on the image, with the result that the image quality may be degraded.

SUMMARY OF THE INVENTION

An object of the present invention is to provide a developing device and an image forming apparatus capable of eliminating image jitter and capable of preventing the degradation of image quality, even when the printing speed increases.

The present invention provides a developing device including a developer bearing body disposed in opposition to a latent image bearing body for bearing a latent image thereon. The developer bearing body develops the latent image using a developer. The developer has a degree of circularity greater than or equals to 0.93. The developing device further includes a developer layer forming member that contacts the developer on the developer bearing body to thereby form a developer layer. The developer bearing body rotates at a circumferential speed within a range from 185 mm/sec to 250 mm/sec. An initial fluidity of the developer is greater than or equals to 80%, and a tapping density of the developer is less than or equals to 35%.

The present invention also provides a developing device including a developer bearing body disposed in opposition to a latent image bearing body for bearing a latent image thereon. The developer bearing body develops the latent image using a developer. The developer has a degree of circularity less than 0.93. The developing device further includes a developer layer forming member that contacts the developer on the developer bearing body to thereby form a developer layer. The developer bearing body rotates at a circumferential speed within a range from 185 mm/sec to 250 mm/sec. An initial fluidity of the developer is greater than or equals to 74%, and a tapping density of the developer is less than or equals to 40%.

With such an arrangement, it becomes possible to eliminate image jitter when the printing speed is within the range from 185 mm/sec to 250 mm/sec.

DETAILED DESCRIPTION OF THE PREFERRED EMBODIMENT

Embodiments of the present invention will be described with reference to the attached drawings.

First Embodiment

Figure 1:
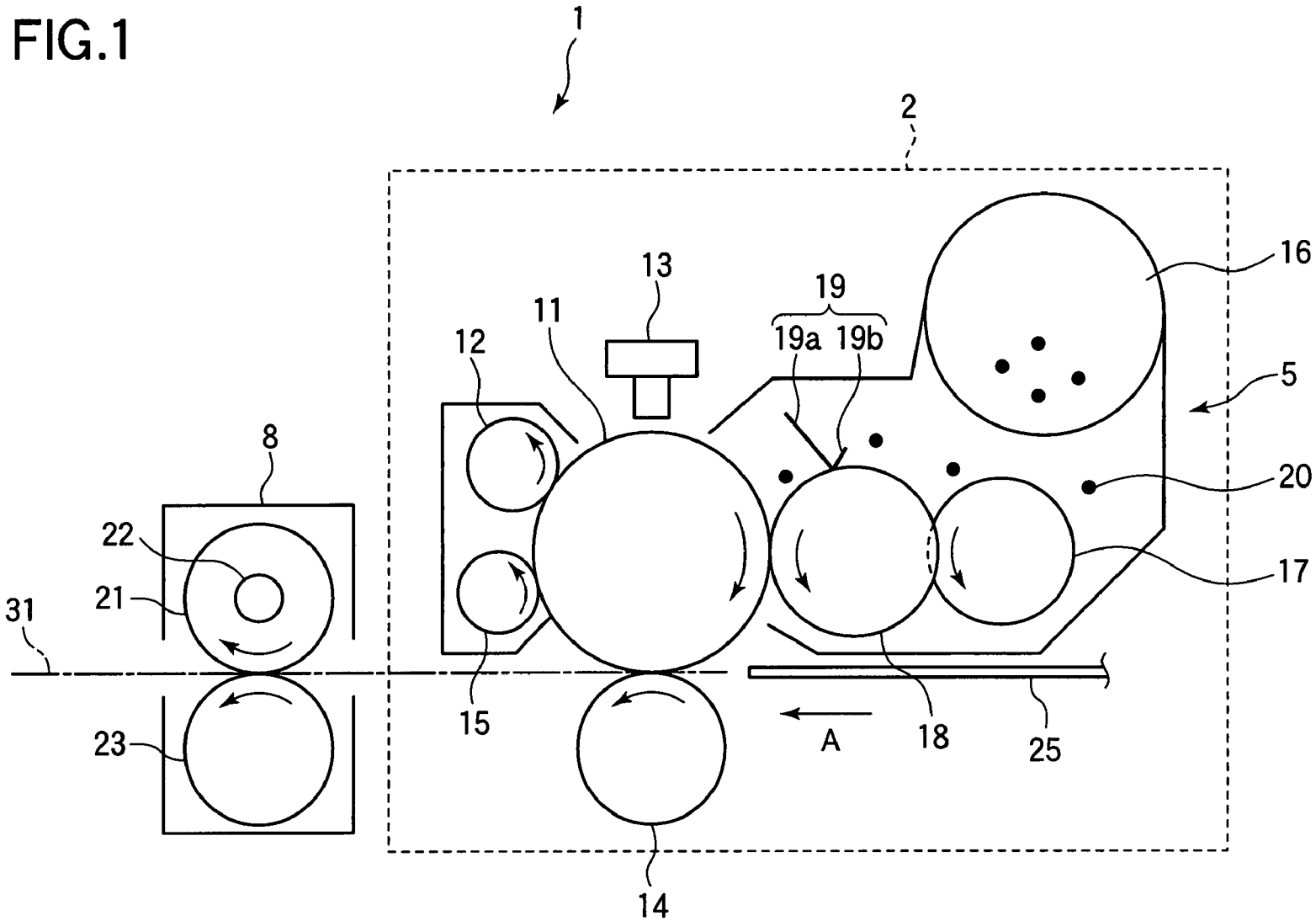
FIG. 1 is a schematic view showing a configuration of a main part of an image forming apparatus according to the embodiments of the present invention.

FIG. 1 is a schematic view showing a configuration of an image forming apparatus 1 according to the first embodiment of the present invention.

As shown in FIG. 1, the image forming apparatus 1 takes the form of, for example, an electrophotographic printer. The image forming apparatus 1 includes an image forming portion 2 and a fixing portion 8. The image forming portion 2 includes a photosensitive drum 11 as a latent image bearing body. The image forming portion 2 includes a charging roller 12, an LED head 13, a developing portion 5, a transfer roller 14 and a cleaning roller 15 disposed along the circumference of the photosensitive drum 11 in this order from the upstream to the downstream in the rotational direction of the photosensitive drum 11.

The photosensitive drum 11 is provided for forming a latent image on the surface thereof. The photosensitive drum 11 includes a drum-shaped conductive body composed of, for example, Aluminum and a photoconductive layer formed on the surface of the conductive body. The photosensitive drum 11 is rotated in the direction shown by an arrow in FIG. 1 by a not shown driving mechanism. The charging roller 12 is disposed in contact with the photosensitive drum 11, for uniformly charging the surface of the photosensitive drum 11. The LED head 13 is provided for exposing the surface of the photosensitive drum 11 to form a latent image thereon. The LED head 13 includes, for example, LED elements and lens array, and is disposed so that lights emitted by the LED elements are focused on the surface of the photosensitive drum 11.

The developing portion 5 (i.e., a developing device) includes a developing roller 18 as a developer bearing body, a sponge roller 17 as a developer supplying member, a developing blade 19 as a developer layer forming member, and a toner cartridge 16 for storing a toner 20 that falls and is supplied to the sponge roller 17. The sponge roller 17 supplies the toner 20 (having fallen from the toner cartridge 16) to the developing roller 18. The developing blade 19 forms a thin toner layer on the surface of the developing roller 18. The developing roller 18 develops the latent image on the surface of the photosensitive drum 11 so as to form a toner image, using the toner transferred from the surface of the developing roller 18 to the latent image on the photosensitive drum 11.

The transfer roller 14 as the transfer member transfers the toner image (i.e., a developer image) from the photosensitive drum 11 to a printing medium 25. The cleaning roller 15 scrapes off the toner 20 remaining on the surface of the photosensitive drum 11 without being transferred to the printing medium 25. As described above, the photosensitive drum 11 contacts the charging roller 12, the developing roller 18, the transfer roller 14 and the cleaning roller 15. The developing roller 18 contacts the sponge roller 17 and the developing blade 19.

In this embodiment, the developing roller 18 includes a core of steel whose surface is plated with nickel, and a layer of silicone sponge rubber having a hardness within a range from 35 to 45 degrees (measured by JIS-A hardness tester) formed on the surface of the core. The developing blade 19 is formed of two bonded stainless plates each having a thickness of 0.08 mm. The developing blade 19 is bent to have a shorter section 19*a* and a longer section 19*b*. The developing blade 19 is fixed at an end of the longer section 19*b* in such a manner that the shorter section 19*a* and the longer section 19*b* are respectively disposed on the upstream side and the downstream side in the rotational direction of the developing roller 18 shown by an arrow in FIG. 1. The developing blade 19 contacts the developing roller 18 with a linear pressure within a certain range, for example, from 25 to 69 gf/mm.

The fixing portion 8 is disposed on the downstream side of the image forming portion 2 in the feeding direction (shown by an arrow A in FIG. 1) of the printing medium 25 along a feeding path 31. The fixing portion 8 includes a cylindrical heat roller 21 formed of an aluminum tube whose surface is coated with PFA (perfluoroalkoxy-alkane) or PTFE (poly-tetra-fluoro-ethylene). The fixing portion 8 further includes a halogen lamp 22 as a heat source provided in the heat roller 21 and a backup roller 23 formed of a resilient roller. The heat roller 21 and the backup roller 23 are pressed against each other.

The charging roller 12, the developing roller 18, the sponge roller 17, the transfer roller 14 and the LED head 13 of the image forming portion 2, and the halogen lamp 22 of the fixing portion 8 are supplied with bias voltages by means of a not shown power source provided in the main body of the image forming apparatus 1. The power source is generally used as a high voltage power source in electrophotographic printer, and is controlled by a not shown controller.

Next, the toner 20 used in the image forming apparatus 1 and stored in the toner cartridge 16 of the developing portion 5 will be described below.

In the image forming apparatus 1 of the first embodiment, the developing roller 18 rotates at a circumferential speed Vg within a range from 185 mm/sec to 250 mm/sec as described later. Further, a polymerized toner used in the first embodiment has an initial fluidity greater than or equals to 80%, and has a tapping density (also referred to as a saturated compressibility) less than 35%.

The initial fluidity and the tapping density of the toner are measured as described below.

Figure 2:
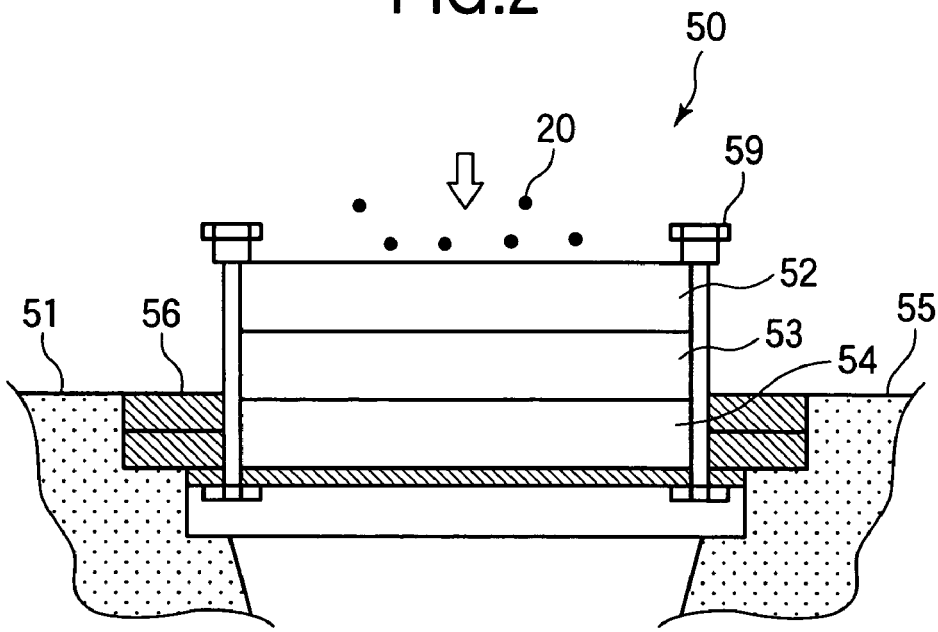
FIG. 2 is a schematic view illustrating a method for measuring an initial fluidity of a developer using a powder testing equipment.

The initial fluidity of the toner (i.e., the fluidity of the unused toner) is measured using a powder testing equipment 50 ("Powder Tester PT-N" manufactured by Hosokawa Micron Limited). FIG. 2 is a schematic view showing the method for measuring the initial fluidity using the powder testing equipment 50. On the measurement, as shown in FIG. 2, a sieve 54 having a mesh size of 45 μm, a sieve 53 having a mesh size of 75 μm and a sieve 52 having a mesh size of 150 μm are set on a vibration table 51 via a holding frame 56 in such a manner that the sieves 54, 53 and 52 are layered in this order starting from the bottom. Then, the sieves 54, 53 and 52 are fixed to the vibration table 51 via the holding frame 56 using fixing members 59. In this state, 4.0 g of new (unused) toner is softly placed on the uppermost sieve 52 (having the mesh size of 150 μm), and the vibration table 51 vibrates for 15 seconds with a vibration amplitude of 1.0 mm.

Then, the amounts of the toners remaining on the respective sieves 54, 53 and 52 are measured, and the fluidity of the toner is calculated based on a value "Z" as follows.

Z=(weight (g) of the toner on the sieve 52 whose mesh size is 150 μm/4.0)×100

+(weight (g) of the toner on the sieve 53 whose mesh size is 75 μm/4.0)×(3/5)×100

+(weight (g) of the toner on the sieve 54 whose mesh size is 45 μm/4.0)×(1/5)×100.

Fluidity of the toner (%)=100−Z

The measurements on the same condition are carried out three times, and the average of the fluidities provides "initial fluidity". The value "Z" is generally referred to as cohesiveness.

Figure 3A:
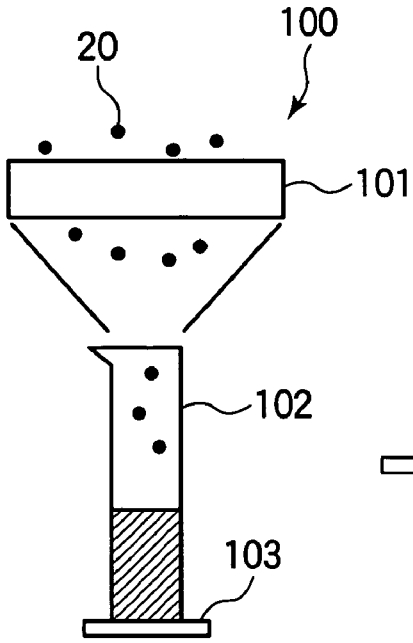
FIGS. 3A and 3B are schematic views illustrating a method for measuring a tapping density (i.e., a saturated compressibility) of the developer using a particle-density testing equipment.
Figure 3B:
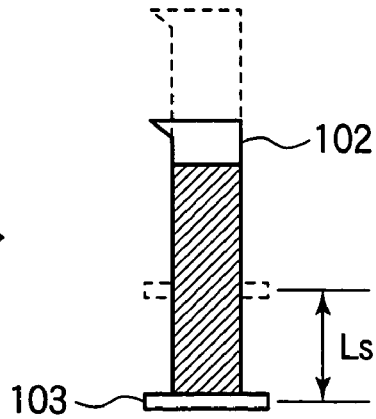

The tapping density (also referred to as a saturated compressibility) is measured using a particle-density measuring equipment ("Multi-tester MT 1001" manufactured by Seishin Enterprise Co., Ltd.). FIGS. 3A and 3B are schematic views illustrating the method for measuring the tapping density using the particle-density measuring equipment. On the measurement, as shown in FIG. 3A, a 100 cc measuring cylinder 102 is set on a vertically movable table 103. Then, the toner falls in the measuring cylinder 102 via a sieve 101 having a mesh size of 250 μm until the amount of the toner in the measuring cylinder 102 reaches 100 cc.

In this state, the weight of the toner is measured. Based on the measured weight, the initial density "dmin" (g/cc(cm$^3$)) of the toner is determined.

Next, as shown in FIG. 3B, the measuring cylinder 102 in which the toner is stored is moved upward with a stroke Ls of 18 mm, and moves downward to its original position. This movement of one stroke including upward and downward movements is counted as one tapping. The tapping is repeated until the density of the toner is saturated (i.e., until the decrease in the volume of the toner is saturated). Then, the volume of the toner is measured. Base on the measured volume, the saturated density "dmax" (g/cc (cm$^3$)) of the toner is determined.

Then, based on the initial density dmin and the saturated density dmax, the tapping density is calculated as follows:

Tapping density (%)=(dmax−dmin)/dmax×100.

Hereinafter, a method for manufacturing a single-component nonmagnetic polymerized toner used in this embodiment will be described.

77.5 weight parts of styrene, 22.5 weight parts of acrylic acid-n-butyl, 2 weigh parts of low-molecular weight polyethylene (as offset-preventing agent), 1 weight part of charge-control agent ("Aizen Spilon Black TRH" manufactured by Hodogaya Chemical Co., Ltd.), 6 weight parts of carbon black ("Printex L" manufactured by Degussa AG) and 1 weight part of 2,2'-azobisisobutylonitrile are put in a mixing/dispersion equipment ("Attritor MA-01SC" manufactured by Mitsui-Miike-Machinery Co., Ltd.) and is dispersed for 10 hours at the temperature of 15° C., with the result that a polymerizable composition is obtained. Then, 180 weight parts of ethanol is prepared, in which 8 weight parts of polyacrylic acid and 0.35 weight parts of divinylbenzene are solved. 600 weight parts of distillated water is added to the ethanol, so that a dispersion medium is prepared. Next, the above described polymerizable composition is added to the dispersion medium, and is dispersed in an emulsification/dispersion equipment ("TK Homo Mixer" manufactured by Tokusyukika-Kogyo Co., Ltd.) at the rotation speed of 8000 rpm for 10 minutes at the temperature of 15° C. Then, the resultant dispersion solution is put into a separable 1 liter flask, and is agitated at 100 rpm in the nitrogen atmosphere for 12 hours at the temperature of 85° C. so as to cause the reaction. A dispersion solute obtained by the polymerization reaction of the polymerizable composition is referred to as intermediate particles.

Next, an aqueous emulsion is prepared, which includes 9.25 weight parts of methyl methacrylate, 0.75 weight parts of acrylic acid-n-butyl, 0.5 weight parts of 2,2'-azobisisobutylonitrile, 0.1 weight parts of sodium lauryl sulfate and 80 weight parts of water, using ultrasonic transmitter ("US-150" manufactured by Nippon-Seiki Co., Ltd.). 9 weight parts of this aqueous emulsion is dropped (as droplets) in a water-based suspension in which the intermediate particles are suspended, so that the intermediate particles are swollen. Then, whether the emulsion drops disappear or not (i.e., the swelling of the intermediate particles is completed or not) is checked using an optical microscope. After the disappearance of the emulsion drops is confirmed, the suspension is agitated under the nitrogen atmosphere at the temperature of 85° C. for 10 hours so as to cause a polymerization reaction of the second stage. Then, the suspension is cooled. After the cooling, the dispersion medium is solved in aqueous hydrochloric solution of 0.5N, filtrated, rinsed in water, and air-dried. Next, the resultant particles are dried at the temperature of 40° C. for 10 hours under a reduced pressure (10 mmHg), and classified using an air stream classifier, with the result that a base toner whose mean particle diameter is 7 μm is obtained. Then, 0.35 weight parts of hydrophobic silica fine powders ("Aerosil R-972" manufactured by Nippon Aerosil Co., Ltd.) are added to 50 weight parts of the base toner, with the result that a toner E is obtained.

Further, by varying the kind and amount of the fine particles added to the base toner, toners A, B, C, D, F and G having different initial fluidity and different tapping density are obtained.

The fine particles are formed of, for example, silica, alumina, titanium oxide, barium titanate, magnesium titanate, calcium titanate, strontium titanate, zinc oxide, silica sand, clay, mica, wollastonite, silious earth, chromium oxide, cerium oxide, colcothar, antimony trioxide, magnesium oxide, zirconium oxide, barium sulfate, barium carbonate, calcium carbonate, silicon carbide, silicon nitride or the like.

The fine particles of silica have Si-O-Si bonds, and can be manufactured using dry method or wet method. The fine particles of silica can be any of anhydrous silica dioxide, aluminum silicate, sodium silicate, potassium silicate, magnesium silicate, zinc silicate or the like. The surfaces of the fine particles can be processed with silane coupling agent, titan coupling agent, silicon oil, silicon oil having amine in the side-chain, or the like.

The above prepared toner is referred to as a polymerized toner, and the degree of circularity of the polymerized toner is measured. The degree of circularity of the polymerized toner is greater than or equals to 0.93. A method for measuring the degree of circularity of the toner is described below.

On the measurement of the degree of circularity, 4 to 6 droplets (approximately 0.5%) of neutral detergent are dropped in a beaker, and 100 ml of electrolytic solution is put in the beaker. Then, the beaker is slightly vibrated so that the detergent is solved, and a scoopful of the toner using a micro-spatula is put in the beaker. Next, the toner is dispersed in the beaker using a ultrasonic cleaner for 60 seconds, and the following lengths L1 and L2 are measured using a flow particle image analyzer ("FPIA-2000" manufactured by Sysmex Corporation):

L1: the length of the circumference of a circle having the same area as a projected image of the toner particle, and L2: the length of the circumference of the projected image of the toner particle.

Based on the lengths L1 and L2, the degree of circularity is calculated as follows:

Degree of circularity=L1/L2.

When the degree of circularity is 1, the shape of the toner particle is a perfect sphere. As the degree of circularity decreases from 1, the shape of the toner particle becomes indeterminate.

Using the seven kinds of polymerized toners A through G having different initial fluidity and different tapping density, the image forming apparatus 1 performs the continuous printing test. The printing test and the result thereof will be described below.

First, the printing operation of the image forming apparatus 1 will be described. In the image forming apparatus 1, the respective rotating members (such as the photosensitive drum 11) are transmitted with rotations from the motors (not shown) controlled by the controller (not shown) via the predetermined rotation transmitting paths (not shown), and rotate in the respective directions shown by arrows in FIG. 1 at the respective predetermined speeds. Further, at almost the same time as the rotation of the motor, the predetermined portions of the respective rollers or the like and the halogen lamp 22 of the fixing portion 8 are applied with bias voltages by the power source (not shown) provided in the main body of the image forming apparatus 1.

The surface of the photosensitive drum 11 is uniformly charged by the charging roller 12 applied with the voltage and transmitted with the rotation. When the charged portion of the photosensitive drum 11 reaches the position beneath the LED head 13, the LED head 13 emits light in accordance with the data of an image to be printed sent by the not shown controller, so that a latent image is formed on the surface of the photosensitive drum 11. When the latent image on the photosensitive drum 11 reaches the developing roller 18, the toner 20 of the toner layer on the developing roller 18 (formed by the developing blade 19) moves to the latent image on the photosensitive drum 11 due to the difference in electric potential between the latent image and the developing roller 18, so that the latent image is developed, i.e., the toner image is formed.

Then, the transfer roller 14 transfers the toner image from the surface of the photosensitive drum 11 to the printing medium 25. The toner image is fixed to the printing medium 25 due to the heat of the heat roller 21 (heated by the halogen lamp 22) and the pressure between the heat roller 21 and the backup roller 23. The toner that remains on the photosensitive drum 11 is scraped off from the photosensitive drum 11 by the cleaning roller 15, and recovered by the developing portion 5 in accordance with the predetermined sequence determined by the not shown controller.

The image forming apparatus 1 (configured to operate as described above) performs continuous printing on A4-size papers using seven kinds of polymerized toners A through G having different initial fluidity and different tapping density, while varying the circumferential speed Vg of the developing roller 18 under the following conditions (1) through (5), and the printing result is evaluated.

(1) 72 g of the toner stored in the toner cartridge 16 is supplied to the image forming apparatus 1.

(2) A solid image (having an image density of 100%) is printed, which is taken as a printing sample "initial".

(3) After 2000 pages continuous printing of the image having an image density of 1.25%, a solid image (having an image density of 100%) is printed, which is taken as a printing sample "2.0K".

(4) 150 g of the toner is added to the toner cartridge 16.

(5) After further 2000 pages continuous printing of the image having an image density of 1.25%, a solid image (having an image density of 100%) is printed, which is taken as a printing sample "4.0K".

The amount of the toner in the developing portion 5 (FIG. 1) is at its maximum while 1900 to 2000 pages are printed (particularly, just before the printing of 2000 pages is completed) after 150 g of the toner is added. When the amount of the toner in the developing portion 5 is at its maximum, the pressure of the contact portion between the developing roller 18 and the developing blade 19 is at its maximum. Therefore, if the image jitter does not appear on this stage, it can be considered that the image jitter will not appear afterward, because the pressure in the contact portion between the developing roller 18 and the developing blade 19 will gradually decrease according to the consumption of the toner in the developing portion 5.

The printing samples "4.0K" for the respective polymerized toners A through G and for the respective circumferential speed Vg are observed with naked eyes, to check whether the image jitter appears or not. The result is shown in TABLE 1. In TABLE 1, "X" indicates that the image jitter is observed, and "O" indicates that the image jitter is not observed. Further, the initial fluidity and the tapping density are also shown in TABLE 1. In this regard, the number of taps to obtain the above described saturated density "dmax" is set to 2000 for purpose of accuracy, although the saturation of the density can be obtained even when the number of taps is 1500.

TABLE 1

| TONER | INITIAL FLUIDITY (%) | TAPPING DENSITY (%) | CIRCUMFERENTIAL SPEED Vg (mm/sec) | IMAGE JITTER |
|---|---|---|---|---|
| A | 68 | 40 | 185 | X |
| B | 75 | 38 | 185 | X |
| C | 82 | 37 | 185 | X |
| D | 70 | 34 | 185 | X |
| E | 80 | 35 | 185 | ○ |
| | | | 200 | ○ |
| | | | 250 | ○ |
| | | | 270 | X |
| F | 85 | 30 | 185 | ○ |
| | | | 200 | ○ |
| | | | 250 | ○ |
| | | | 270 | X |
| G | 96 | 27 | 185 | ○ |
| | | | 200 | ○ |
| | | | 250 | ○ |
| | | | 270 | X |

As shown in TABLE 1, in the case where the toners A, B, C and D are used, the image jitter is observed on the printing sample "4.0K" when the circumferential speed Vg of the developing roller 18 is 185 mm/sec. In this regard, as the printing speed (corresponding to the circumferential speed Vg) increases, the amount of the toner supplied to the contact portion between the developing roller 18 and the developing blade 19 also increases. In such a case, the pressure in the contact portion increases, and therefore the packing of the toner is more likely to occur. For this reason, the checking of the image jitter is not carried out at the higher speed for the toners A, B, C and D. In the case where the toners E, F and G are used, the image jitter is not observed on the printing sample "4.0K" when the circumferential velocity Vg is in a range from 185 to 250 mm/sec, and the image jitter is first observed when the circumferential velocity Vg is increased to 270 mm/sec.

The same evaluations are carried out at the temperature of 23° C. and the humidity of 55%, at the temperature of 10° C. and the humidity of 20%, and at the temperature of 28° C. and the humidity of 80%. The results of the evaluations are the same as one another.

In the image forming apparatus 1, the toner having a degree of circularity greater than or equals to 0.93 is used as the developer, the circumferential speed Vg of the developing roller 18 is within the range from 185 mm/sec to 250 mm/sec, the initial fluidity of the toner is greater than or equals to 80% and the tapping density of the toner is less than or equals to 35%. With such conditions, it becomes possible to print an excellent image without image jitter.

As described above, in accordance with increase in the printing speed, the amount of the toner supplied to the vicinity of the contact portion between the developing roller 18 and the developing blade 19 may increase, and therefore the pressure in the contact portion may increase. In such a case, the packing of the toner may be more likely to occur in the conventional image forming apparatus. However, in this embodiment, the toner has the initial fluidity and the tapping density so that the packing of the toner hardly occurs, and therefore the image jitter can be prevented. Accordingly, by defining the initial fluidity and the tapping density as in this embodiment, it becomes possible to print an excellent image with no image jitter at a printing speed (for example, from 185 mm/sec to 250 mm/sec) higher than the conventional printing speed (for example, from 20 mm/sec to 150 mm/sec).

Second Embodiment

In the second embodiment, the image forming apparatus 1 described in the first embodiment operates so that the developing roller 18 rotates at a circumferential speed Vg from 185 mm/sec to 250 mm/sec, and a pulverized toner having an initial fluidity greater than or equals to 74% and a tapping density less than or equals to 40% is used. First, the pulverized toner used in the second embodiment will be described.

In the second embodiment, the pulverized toner having a degree of circularity less than 0.93 is used. The term "pulverized toner" is used to mean the toner manufactured by preparing a toner block using kneading, and by mechanically pulverizing the toner block. Compared with the polymerized toner, the pulverized toner has an uneven shape, and has a wider particle-size distribution, and therefore the packing of the toner hardly occurs. Hereinafter, the single-component nonmagnetic pulverized toner will be described.

100 weight parts of polyester resin (having a number average molecule weight of 3700 and a grass transition temperature Tg of 62° C.) as a binding agent, 1 weight part of salicylic acid complex as a charge controlling agent, 3 weight parts of phthalocyanine (C. I. Pigment Blue 15:3) as a coloring agent, and 10 weight parts of a releasing agent (whose grass transition temperature Tg is 100° C.) are blended and agitated using a mixing equipment ("Henschel Mixer" manufactured by Mitsui-Miike-Machinery Co., Ltd.). Then, the resultant blended material is kneaded and heated using an open-roll type continuous kneading equipment ("Neadex" manufactured by Mitsui Mining Co., Ltd.) at the temperature of 100° C. for approximately 3 hours, and cooled. Next, the resultant material is pulverized using a pulverizing equipment with an impact plate using jet stream ("Dispersion Separator" manufactured by Nippon Pneumatic Manufacturing Co., Ltd.). Then, the pulverized material is classified using a dry air-stream classifier of a rotor type using centrifugal force ("Micron Separator" manufactured by Hosokawa Micron Limited), with the result that a base toner whose mean particle diameter is 8 μm is obtained.

Then, 2 weight parts of hydrophobic silica fine powders ("Aerosil R-972" manufactured by Nippon Aerosil Co., Ltd.) as external additives are added to 100 weight parts of the base toner. The external additives and the toner are mixed using the above described Henschel Mixer at the rotation speed of 1000 rpm for 90 seconds so that the external additives attach to the surface of the particles of the base toner, with the result that a toner L is obtained.

Further, by varying the kind and amount of the fine particles (external additives) added to the base toner, sixth kinds of toners H, I, J, K, M and N having different initial fluidity and different tapping density are obtained. The example of the fine particles and the method for measuring the initial fluidity and the tapping density are the same as those described in the first embodiment, and therefore duplicate explanation is omitted.

The degree of circularity of the above prepared toner (i.e., the pulverized toner) is measured. As the result of the measurement, the degree of circularity of the toner is less than 0.93. The method for measuring the degree of circularity is the same as that described in the first embodiment.

Next, the continuous printing test and the result thereof using the image forming apparatus 1 and using the seven kinds of pulverized toners L through N having different initial fluidity and tapping density will be described. The structure and the operation of the image forming apparatus 1 are the same as those described in the first embodiment, and duplicate explanation is omitted.

The image forming apparatus 1 performs continuous printing using seven kinds of polymerized toners L through N having different initial fluidity and different tapping density, while varying the circumferential speed Vg of the developing roller 18 under the following conditions (1) through (5), and the printing result is evaluated.

(1) 72 g of the toner stored in the toner cartridge 16 is supplied to the image forming apparatus 1.

(2) A solid image (having an image density of 100%) is printed, which is taken as a printing sample "initial".

(3) After 2000 pages continuous printing of the image having an image density of 1.25%, a solid image (having an image density of 100%) is printed, which is taken as a printing sample "2.0K".

(4) 150 g of the toner is added to the toner cartridge 16.

(5) After further 2000 pages continuous printing of the image having an image density of 1.25%, a solid image (having an image density of 100%) is printed, which is a taken as a printing sample "4.0K".

These conditions (1) through (5) are the same as those described in the first embodiment.

The printing samples "4.0K" for the respective polymerized toners H through N and for the respective circumferential speed Vg are observed with naked eyes, to check whether the jitter appears or not. The result is shown in TABLE 2. In TABLE 2, "X" indicates that the image jitter is observed, and "0" indicates that the image jitter is not observed, Further, the initial fluidity and the tapping density are also shown in TABLE 2. In this regard, the number of taps to obtain the above described saturated density "dmax" is set to 2000 for purpose of accuracy, although the saturation of the density can be obtained even when the number of taps is 1500.

TABLE 2

| TONER | INITIAL FLUIDITY (%) | TAPPING DENSITY (%) | CIRCUMFERENTIAL SPEED Vg (mm/sec) | IMAGE JITTER |
|---|---|---|---|---|
| H | 69 | 42 | 185 | X |
| I | 76 | 41 | 185 | X |
| J | 68 | 38 | 185 | X |
| K | 74 | 40 | 185 | ○ |
| | | | 200 | ○ |
| | | | 250 | ○ |
| | | | 270 | X |
| L | 80 | 31 | 185 | ○ |
| | | | 200 | ○ |
| | | | 250 | ○ |
| | | | 270 | X |
| M | 88 | 29 | 185 | ○ |
| | | | 200 | ○ |
| | | | 250 | ○ |
| | | | 270 | X |
| N | 92 | 25 | 185 | ○ |
| | | | 200 | ○ |
| | | | 250 | ○ |
| | | | 270 | X |

As shown in TABLE 2, in the case where the toners H, I and J are used, the image jitter is observed on the printing sample (4.0K) when the circumferential speed Vg of the developing roller 18 is 185 mm/sec. In this regard, as the printing speed (corresponding to the circumferential speed Vg of the developing roller 18) increases, the amount of the toner supplied to the contact portion between the developing roller 18 and the developing blade 19 also increases. In such a case, the pressure in the contact portion increases, and therefore the packing of the toner is more likely to occur. For this reason, the checking of the image jitter is not carried out at the higher speed for the toners H, I and J. In the case where the toners K, L, M and N are used, the image jitter is not observed on the printing sample (4.0K) when the circumferential velocity Vg is in a range from 185 to 250 mm/sec, and the image jitter is first observed when the circumferential velocity Vg is increased to 270 mm/sec.

The same evaluations are carried out at the temperature of 23° C. and the humidity of 55%, at the temperature of 10° C. and the humidity of 20%, and at the temperature of 28° C. and the humidity of 80%. The results of the evaluations are the same as one another.

In the image forming apparatus 1, the toner having a degree of circularity less than 0.93 is used as the developer, the circumferential speed Vg of the developing roller 18 is within the range from 185 mm/sec to 250 mm/sec, the initial fluidity of the toner is greater than or equals to 74% and the tapping density of the toner is less than or equals to 40%. With such conditions, it becomes possible to print an excellent image without image jitter.

As described above, in accordance with the increase in the printing speed, the amount of the toner supplied to the vicinity of the contact portion between the developing roller 18 and the developing blade 19 increases, and therefore the pressure in the contact portion may increase. In such a case, the packing of the toner may be more likely to occur in the conventional image forming apparatus. However, in this embodiment, the toner has the initial fluidity and the tapping density so that the packing of the toner hardly occurs, and therefore the image jitter can be prevented. Accordingly, by defining the initial fluidity and the tapping density as in this embodiment, it becomes possible to print an excellent image with no image jitter at a printing speed (for example, from 185 mm/sec to 250 mm/sec) higher than the conventional printing speed (for example, from 20 mm/sec to 150 mm/sec).

Although the present invention has been described with reference to the image forming apparatus in the form of an electrophotographic printer, the present invention is not limited to the electrophotographic printer but is applicable to other apparatus using electrophotography such as a facsimile machine, a copier or the like.

Further, the material and the structure of the developing roller and the developing blade and the material of the toner are merely an example, and it is also possible to use other developing roller, developing blade and the toner. When the initial fluidity and the tapping density of the toner is within the above described range, the above described advantages can be obtained.

While the preferred embodiments of the present invention have been illustrated in detail, it should be apparent that modifications and improvements may be made to the invention without departing from the spirit and scope of the invention as described in the following claims.

What is claimed is:

1. A developing device comprising:

developer having a degree of circularity greater than or equal to 0.93;

a developer bearing body disposed in opposition to a latent image bearing body for bearing a latent image thereon, said developer bearing body developing said latent image using said developer, and a developer layer forming member that contacts said developer on said developer bearing body to thereby form a developer layer, wherein said developer bearing body rotates at a circumferential speed within a range from 185 mm/sec to 250 mm/sec, wherein an initial fluidity of said developer is greater than or equal to 80%, and a tapping density of said developer is less than or equal to 35%.

2. The developing device according to claim 1, wherein said developer is a single-component nonmagnetic developer.

3. The developing device according to claim 1, wherein said developer is a polymerized toner.

4. An image forming apparatus comprising:

said developing device according to claim 1, a transfer member that transfers said developer from said latent image bearing body to a printing medium, and a fixing portion that fixes said developer to said printing medium.

5. The developing device according to claim 1, wherein said initial fluidity is obtained by placing unused developer of a predetermined amount on a sieve and vibrating said sieve for a predetermined time, and said initial fluidity is determined based on an amount of said unused developer passed through said sieve after the application of said vibration.

6. The developing device according to claim 5, wherein said initial fluidity is obtained by the steps of:

(a) placing 4.0 g of unused developer on an uppermost sieve of three sieves of mesh sizes of 45 μm, 75 μm and 150 μm layered in this order from the bottom, (b) vibrating said sieves for 15 seconds with a vibration amplitude of 1.0 mm, (c) measuring amounts of said developers remaining on respective sieves, (d) determining a fluidity (%) of said developer according to the measured amounts of said developers based on the following relationships:

said fluidity =100−Z, where Z =(weight (g) of the developer on the sieve whose mesh size is 150 μm/ 4.0) x 100

+(weight (g) of the developer on the sieve whose mesh size is 75 μm/ 4.0) ×(3/5) ×100

+(weight (g) of the developer on the sieve whose mesh size is 45 μm/ 4.0) ×(1/5) ×100, wherein said steps (a) to (d) are carried out three times, and an average of said fluidity is determined as said initial fluidity (%).

7. The developing device according to claim 1, wherein said tapping density is obtained by a rate of change in a density of said developer of a predetermined amount before a vibration is applied to said developer and after said vibration is applied to said developer.

8. The developing device according to claim 7, wherein said density after the application of said vibration is determined by a density after said vibration is continued until a change in volume of said developer is saturated.

9. The developing device according to claim 8, wherein said tapping density is measured by the steps of:

(a) putting said developer in a measuring cylinder of 100 cc via a sieve having a mesh size of 250 μm until an amount of said developer in said measuring cylinder reaches 100 cc, (b) measuring a weight of said developer, and determining an initial density dmax based on a measured weight, (c) vibrating said measuring cylinder until a change in volume of said developer is saturated, (d) measuring a volume of said developer, and determining a saturated density dmin base on a measured volume, and (e) determining said tapping density according to the following equation:

Tapping density (%) ={(dmax −dmin)/dmax}×100.

10. A developing device comprising:

developer having a degree of circularity greater than or equal to 0.93;

a developer bearing body disposed in opposition to a latent image bearing body for bearing a latent image thereon, said developer bearing body developing said latent image using said developer, and a developer layer forming member that contacts said developer on said developer bearing body to thereby form a developer layer, wherein said developer bearing body rotates at a circumferential speed within a range from 185 mm/sec to 250 mm/sec, wherein an initial fluidity of said developer is greater than or equal to 74%, and a tapping density of said developer is less than or equal to 40%.

11. The developing device according to claim 10, wherein said developer is a single-component nonmagnetic developer.

12. The developing device according to claim 10, wherein said developer is a pulverized toner.

13. An image forming apparatus comprising:

said developing device according to claim 10, a transfer member that transfers said developer from said latent image bearing body to a printing medium, and a fixing portion that fixes said developer to said printing medium.

14. The developing device according to claim 10, wherein said initial fluidity is obtained by placing unused developer of a predetermined amount on a sieve and vibrating said sieve for a predetermined time, and said initial fluidity is determined based on an amount of said unused developer passed through said sieve after the application of said vibration.

15. The developing device according to claim 14, wherein said initial fluidity is obtained by the steps of:

(a) placing 4.0 g of unused developer on an uppermost sieve of three sieves of mesh sizes of 45 μm, 75 μm and 150 μm layered in this order from the bottom, (b) vibrating said sieves for 15 seconds with a vibration amplitude of 1.0 mm, (c) measuring amounts of said developers remaining on respective sieves, (d) determining a fluidity (%) of said developer according to the measured amounts of said developers based on the following relationships:

said fluidity =100−Z, where Z =(weight (g) of the developer on the sieve whose mesh size is 150 μm/ 4.0) ×100

+(weight (g) of the developer on the sieve whose mesh size is 75 μm/ 4.0) ×(3/5) ×100

+(weight (g) of the developer on the sieve whose mesh size is 45 μm/ 4.0) ×(1/5) ×100 wherein said steps (a) to (d) are carried out three times, and an average of said fluidity is determined as said initial fluidity (%).

16. The developing device according to claim 10, wherein said tapping density is obtained by a rate of change in a density of said developer of a predetermined amount before a vibration is applied to said developer and after said vibration is applied to said developer.

17. The developing device according to claim 16, wherein said density after the application of said vibration is determined by a density after said vibration is continued until a change in volume of said developer is saturated.

18. The developing device according to claim 17, wherein said tapping density is measured by the steps of:

(a) putting said developer in a measuring cylinder of 100 cc via a sieve having a mesh size of 250 μm until an amount of said developer in said measuring cylinder reaches 100 cc, (b) measuring a weight of said developer, and determining an initial density dmax based on a measured weight, (c) vibrating said measuring cylinder until a change in volume of said developer is saturated, (d) measuring a volume of said developer, and determining a saturated density dmin base on a measured volume, and (e) determining said tapping density according to the following equation:

Tapping density (%) ={(dmax −dmin)/dmax}×100.

* * * * *

UNITED STATES PATENT AND TRADEMARK OFFICE

CERTIFICATE OF CORRECTION

PATENT NO. : 7,330,683 B2
APPLICATION NO. : 11/582438
DATED : February 12, 2008
INVENTOR(S) : Koichi Matsuzaki It is certified that error appears in the above-identified patent and that said Letters Patent is hereby corrected as shown below:

IN CLAIM 10:
Column 13: line 12; after "circularity", change "greater than or" to --less than--; and line 14, change "equal to 0.93" to --0.93--.

Signed and Sealed this

Fourteenth Day of October, 2008

JON W. DUDAS
*Director of the United States Patent and Trademark Office*